US007839353B2

(12) United States Patent
Bassily

(10) Patent No.: US 7,839,353 B2
(45) Date of Patent: Nov. 23, 2010

(54) ARBITRARILY SHAPED DEPLOYABLE MESH REFLECTORS

(75) Inventor: Samir F. Bassily, Los Angeles, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/544,898

(22) Filed: Aug. 20, 2009

(65) Prior Publication Data

US 2010/0018026 A1 Jan. 28, 2010

Related U.S. Application Data

(62) Division of application No. 11/364,458, filed on Feb. 28, 2006, now Pat. No. 7,595,769.

(51) Int. Cl.
*H01Q 15/20* (2006.01)

(52) U.S. Cl. ..... 343/915

(58) Field of Classification Search ..... 343/915, 343/912, 878, 897, 880–882, 908; 29/469
See application file for complete search history.

(56) References Cited

U.S. PATENT DOCUMENTS

| | | | | |
|---|---|---|---|---|
| 3,707,720 | A | 12/1972 | Staehlin et al. | |
| 4,845,511 | A * | 7/1989 | Grayson et al. | 343/915 |
| 5,440,320 | A | 8/1995 | Lach et al. | |
| 5,488,383 | A * | 1/1996 | Friedman et al. | 343/912 |
| 5,515,067 | A * | 5/1996 | Rits | 343/912 |
| 5,680,145 | A | 10/1997 | Thomson et al. | |

(Continued)

FOREIGN PATENT DOCUMENTS

| | | |
|---|---|---|
| EP | 1321999 | 6/2003 |

(Continued)

OTHER PUBLICATIONS

International Search Report and Written Opinion dated Dec. 11, 2007 in corresponding PCT Patent Application No. PCT/US2007/05185, 19 pages.

*Primary Examiner*—Huedung Mancuso
(74) *Attorney, Agent, or Firm*—Klintworth & Rozenblat IP LLC

(57) ABSTRACT

A method and apparatus for making a mesh reflector that may be used to produce a shaped reflector is provided. The mesh reflector may be an umbrella-style deployable mesh reflector capable of approximating both parabolic and arbitrarily shaped reflecting surfaces, including those with regions of reversed curvature. The reflecting surface may be provided by a soft mesh attached to a highly pre-tensioned net composed of two sets of substantially parallel chords forming a plurality of parallelogram-shaped facets. The net/mesh may be made to conform to the desired shape by pulling and/or pushing on it at each of its facet corners via a set of finely adjustable tension ties and/or compression rods, the distal ends of which react against a set of pre-tensioned catenary-shaped chords disposed on the aft side of the mesh. The net/mesh and the aft catenaries may be supported and pretensioned by a set of substantially stiff radial ribs connected to a central hub by a means capable of providing high deployment torque and a means for controlling and coordinating the deployment of the ribs so that they reach their fully deployed positions nearly simultaneously. Methods for fabricating the mesh and attaching it to the net are also provided.

8 Claims, 15 Drawing Sheets

U.S. PATENT DOCUMENTS

| | | | |
|---|---|---|---|
| 5,963,182 | A | 10/1999 | Bassily |
| 5,969,695 | A | 10/1999 | Bassily et al. |
| 5,990,851 | A | 11/1999 | Henderson et al. |
| 5,996,940 | A | 12/1999 | McVey et al. |
| 6,028,569 | A | 2/2000 | Bassily et al. |
| 6,030,007 | A | 2/2000 | Bassily et al. |
| 6,214,144 | B1 | 4/2001 | Bassily et al. |
| 6,268,835 | B1 | 7/2001 | Toland et al. |
| 6,313,811 | B1 | 11/2001 | Harless |
| 6,321,503 | B1 | 11/2001 | Warren |
| 6,374,565 | B1 | 4/2002 | Warren |
| 6,384,800 | B1 | 5/2002 | Bassily et al. |
| 2005/0104798 | A1 | 5/2005 | Nolan et al. |

FOREIGN PATENT DOCUMENTS

| | | |
|---|---|---|
| EP | 1357633 | 10/2003 |

* cited by examiner

ARBITRARILY SHAPED DEPLOYABLE MESH REFLECTORS

CROSS REFERENCE TO RELATED APPLICATION

This application claims priority to and is a divisional of U.S. patent application Ser. No. 11/364,458 filed Feb. 28, 2006, which is hereby incorporated by reference.

BACKGROUND

1. Field of the Disclosure

The disclosure relates generally to mesh reflectors for antennas, and more particularly relates to mesh reflectors for antennas that may be used on spacecraft, and that are adapted to be stowed in a launch vehicle and subsequently deployed in outer space.

2. Background Description

Over the past four decades, several styles of deployable mesh reflectors have been developed. The great majority of them were intended to approximate parabolic reflector surfaces, although any of them can theoretically be made to approximate other slowly varying surfaces, provided those surfaces do not have regions of negative curvature (i.e., are always curved towards the focus of the reflector). In more recent years, "shaped reflector" technology was developed and is gaining dominance in the space antenna field. So far, however, it has been limited to relatively small solid-surface (or segmented surface) reflectors due to limitations imposed by the fairing sizes of the launch vehicles on which they are flown.

Since the performance of a satellite antenna farm improves as it comprises a larger number of larger diameter reflectors, and since deployable mesh reflectors can be more efficiently packaged on a spacecraft, a greatly improved antenna farm can be produced if a deployable mesh reflector can be made to approximate an optimally-shaped reflector surface (without the "no negative curvature" limitation).

A soft knitted mesh fabricated out of a thin metallic wire (e.g., gold-plated molybdenum wire) is commonly used to form the reflective surface of deployable radio-frequency (RF) antenna reflectors, especially for space-based applications (e.g., for communication satellites). The mesh may be placed and maintained in a desired shape by attaching it to a significantly stiffer net. One problem associated with the fabrication of such a mesh surface entails the ability to maintain the tension in the mesh within a certain desired range, and to terminate/cut the mesh edges in a manner that does not produce objectionable passive inter-modulation (PIM) or electro-static discharge (ESD), through the use of an appropriate mesh edge treatment.

The problem of attaching a mesh surface to a deployable reflector's net structure entails the ability to maintain the tension distribution within the mesh as uniformly as possible as it is attached to the net, to maintain the mesh edge treatment under proper tension and wrinkle-free as it is attached to the outer catenaries of the reflector's net structure, and to minimize the effect of attaching the mesh upon the shape and the tension levels within the net structure.

The ASTRO-MESH Iso-Grid Faceted Mesh Reflector (hereinafter a "Type 1" reflector) is one example of a mesh reflector (see, e.g., U.S. Pat. No. 5,680,145). In this type of reflector, the mesh surface comprises a large number of triangular substantially flat facets. When viewed from a certain direction, the great majority of those triangles appear to be equilateral. The mesh facets are given their shape by being pulled behind a relatively stiff (ideally in extensible) set of highly tensioned straps forming a net with triangular openings. The net is pulled into shape by a set of springs pulling it backwards towards a similar (but possibly shallower) net disposed behind the mesh and curved in the opposite direction.

Another type of reflector is the Radial/Circumferential Faceted Mesh reflector (hereinafter a "Type 2" reflector). The most common examples of this type of reflector are the umbrella-style Radial-rib reflectors used on the TRW TDRS antenna, and the folding-rib reflectors currently produced by Harris Corp.

Yet another Type 2 reflector is shown and described in U.S. patent application Ser. No. 10/707,032, filed on Nov. 17, 2003, the entirety of which is hereby incorporated by reference herein. In this type of reflector, the mesh facets are generally of trapezoidal shapes bounded by a set of radial chords typically coincident with or near the location of, the reflector ribs, and by sets of chords forming concentric polygons extending between those ribs. Often, those substantially circumferential chords are made to more closely conform to the desired surface geometry by pulling down on them (i.e., in a direction pulling the surface away from the reflector focal point) with a set of adjustable tension ties. The loads in these tension ties are typically reacted by another set of chords forming a second set of concentric polygons disposed behind the set of polygons bounding the mesh facets.

Another type of reflector is known as a wrap-rib Parabolic-Cylindrically Faceted Mesh reflector (hereinafter a "Type 3" reflector). The Lockheed wrap-rib reflector has a mesh surface which comprises a relatively small number of facets each approximating a parabolic cylinder. Each of these facets is bounded by two curved parabolic ribs, an outer catenary member, and a part of the circumference of a central hub. The mesh used on these reflectors is designed to have very low shear stiffness and Poisson's ratio, which minimizes its tendency to "pillow" (or curve inwardly—i.e. towards the reflector focus—between the ribs). Typically, this type of reflector would only contain between one and several dozen facets.

"Pillowing" of a mesh is a distortion characterized by bulges (or "pillows") that occur in the mesh due to mechanical strain. "Pillowing" in a knitted wire mesh used as a radio-frequency reflective surface generally degrades performance, and increases the levels of the side lobes of radio-frequency energy reflected from the mesh.

For acceptable RF performance (low insertion loss and low passive intermodulation (PIM)), the mesh should be kept under a certain minimum tension under all temperature conditions. For the surface "pillowing" error to be within acceptable limits, the ratio of the mesh tension to the net tension should not exceed a certain low value. The maximum net tension is limited by the available torque and force provided by the deployable reflector structure and by the desired deployment torque safety margin.

For a planar mesh to be formed into a doubly-curved surface shape, a certain variable strain should be imposed upon the mesh. The stiffer the mesh, the higher the resulting mesh strain variability.

A mesh edge treatment should be provided which will maintain the minimum required tension in the mesh all the way to the outer edge of the reflecting surface.

Upon trimming the mesh to shape, the edge treatment should restrain the cut edges of the mesh wires preventing them from unraveling and minimizing the chances of them casually contacting each other (thus causing PIM). The edge treatment should shield the cut edges of the mesh wires from viewing the antenna feed horn. The edge treatment should be kept wrinkle-free and under tension upon attaching it to the reflector net and its catenaries. The tension in the mesh should be kept as uniform as possible upon attaching it to the net. The shape of the net and its catenaries, and the tension levels in them, should not change significantly upon attaching the mesh to the net.

In prior art, mesh fabricating systems typically use rigid or semi-rigid edge strips along the outer edges (catenaries) of the mesh, and often along the gore seams to lock-in tension in the mesh from the time the mesh is laid out until it is installed on a deployable reflector structure. Systems for retention of the mesh typically use flat strips tensioned by metallic springs located behind the mesh.

Methods have been developed for making, tensioning and retaining mesh surfaces for large deployable reflectors (see, e.g., U.S. Pat. Nos. 5,969,695, 6,214,144 and 6,384,800). The mesh may be fabricated from gores which are directly sewn together and have sewn pockets at their outer edges through which outer catenary chords are passed and used to radially tension the mesh. The mesh may be given its curved shape by retaining it behind the net (i.e., on the side of the net disposed away from the reflector focus) with the members attaching the net to the reflector ribs passing through the mesh openings. No additional attachments between the mesh and the net, or mesh edge treatment, are used according to these methods.

One disadvantage of the aforementioned methods is that they can be used with a gold-plated molybdenum mesh only in non-PIM sensitive applications. In PIM sensitive applications, however, such methods are intended for use with meshes made of a material having an inherently low PIM saturation level, such as ARACON.™. fiber (material available from DuPont, fabricated out of nickel-plated Kevlar fibers). The disadvantage of using ARACON.™. fiber rather than Gold-plated Molybdenum is its increased insertion loss.

Disadvantages associated with other methods that utilize rigid or semi-rigid strips are the increased mass and stiffness associated with the use of those strips. Increased mass is undesirable particularly for space applications due the high cost associated with boosting the antenna into orbit and supporting it during the boost phase of the mission. The high stiffness of the strips is undesirable because: (1) more force is required to shape the strips into an arbitrarily shaped surface; (2) attachment of the mesh edge treatments to the net can significantly alter its tension levels and shape; and (3) it is difficult to maintain uniform tension in the strips unless additional provisions (such as tensioning springs) are added; further increasing the mass, cost, and complexity of the antenna.

While the wrap-rib type reflector can theoretically approximate a shaped surface of either positive or negative curvatures, its use for a shaped reflector application imposes other practical difficulties. Specifically, since the surface shape is provided directly by the rib shapes, it would require that each of the curved ribs be shaped differently—thus substantially increasing the cost of producing the reflector. Additionally, in order to provide enough degrees of freedom to obtain good performance, the number of ribs has to be sufficiently large to provide adequate shaping in the circumferential direction (since there are no features provided in the spans between the ribs for shaping the surface). This can result in further cost increase in addition to corresponding mass and stowed volume increases, all of which are highly undesirable.

With a Type 1 reflector, since three chords (or straps) intersect at each net node, loads can be exchanged between the chords at each node, and thus the tension can vary substantially along any one chord.

Likewise, with a Type 2 reflector, it can be shown from equilibrium analysis that the tension in the radial chords does not stay constant along the length of each chord. For example, tension in a radial chord increases substantially between the chord segments near the center of the reflector and those near its rim. As a result, if the tension at the center was at the required minimum level for an acceptable pillowing error, the tension near the outer rim of the reflector may be several times higher than that required minimum. Additionally, the tension in the circumferential members can vary as they go through each intersection, necessitating individual measurements and adjustments for each segment of each circumferential chord.

In order to guarantee the minimum tension for the life of the typical mesh reflector (and at all temperature conditions) either a substantially higher tension has to be provided to start with (as is the case with Type 1 Reflectors) or a source of flexibility (e.g., a flexible member or a spring) has to be provided to each segment.

Accordingly, there is a need for systems and methods of fabricating a reflective surface for a deployable RF antenna reflector out of a soft metallic wire mesh. Such a system should provide a means for maintaining the tension in the mesh within a certain desired range and to terminate/cut the mesh edges in a manner that does not produce objectionable PIM or ESD through the use of an appropriate mesh edge treatment.

There is also a need for systems and methods of attaching a reflective surface to a relatively stiff net defining the shape of the curved forward surface of a deployable reflector. Such a system should maximize uniformity of the mesh tension during installation, maintain the mesh edge treatment wrinkle-free, and minimize the effect of attaching the mesh upon the shape and the tension levels in the reflector net.

The present disclosure is directed to overcoming one or more of the problems or disadvantages associated with the prior art.

SUMMARY OF THE INVENTION

In accordance with one aspect of the disclosure, a method and apparatus for making a mesh reflector can be used to produce a shaped reflector having both positive and negative curvatures.

According to another aspect of the disclosure, a system and method are provided for fabricating the reflecting surface of a deployable antenna reflector utilizing a soft wire mesh (that may be knitted out of a thin Gold-plated Molybdenum wire) and for attaching it to a relatively stiff net which defines the shape of the curved forward surface of an RF reflector. The fabrication system may use a novel method for cutting and treating the mesh edges which produce an edge protection that is light weight, of low stiffness and low coefficient of thermal expansion (CTE), and minimizes PIM and electrostatic discharge (ESD) potentials. The installation method provides good control of the mesh tension, wrinkle-free mesh edge treatment, and minimizes the effect of attaching the mesh upon the shape and the tension levels in the reflector net.

In accordance with still another aspect of the disclosure, a reflector includes a mesh reflecting surface, and a first set of elongate members attached to the mesh reflecting surface to shape it by applying forces having a significant component in a direction substantially perpendicular to the surface. At least one of the elongate members is capable of applying a compressive force and the remaining elongate members are capable of applying tension forces only or applying either tension or compression forces. Compressive forces applied to the mesh reflecting surface enable the mesh reflecting surface to include regions of reversed curvature with respect to the overall curvature of the mesh reflecting surface. The reflector also may include a second set of elongate members attached to the mesh reflector reflecting surface.

According to a further aspect of the disclosure, an umbrella-style deployable mesh reflector is provided that is capable of approximating both parabolic and arbitrarily shaped reflecting surfaces, including those with regions of reversed curvature. The reflecting surface may be provided by a soft mesh attached to a highly pre-tensioned net composed of two sets of substantially parallel chords forming a plurality of parallelogram-shaped facets. The net/mesh may be made to conform to the desired shape by pulling and/or pushing on it at each of its facet corners via a set of finely adjustable tension ties and/or compression rods, the distal ends of which react against a set of pre-tensioned catenary-shaped chords disposed on the aft side of the mesh. The net/mesh and the aft catenaries may be supported and pre-tensioned by a set of substantially stiff radial ribs connected to a central hub by a means capable of providing high deployment torque and a means for controlling and coordinating the deployment of the ribs so that they reach their fully deployed positions nearly simultaneously.

In order to effect arbitrary shaping of the mesh surface, an ability to apply both tensile and compressive forces to it is provided. This may include the use of a combination of tension ties and compression rods.

In order to ensure the stability of the compression rods, a two-dimensional net of chords may be provided, at least at the top ends of the rods.

Due to the high curvatures typically associated with shaped surfaces, the surface shaping net chords require much higher tension (than that usually used on a parabolic reflector) in order to keep the "pillowing" error at acceptable levels. It is therefore highly desirable that the design would:

a. Simplify the ability to measure the tension level throughout the net (knowledge);

b. Provide a simple means to control the magnitude of the tension in the chords; and c. Provide a means for maintaining the tension in the chords at a stable range.

The need for higher tension in the net results in a need for stronger/stiffer ribs (via a more efficient rib design) and a need for stronger/stiffer deployment hinges (via a more efficient deployment hinge design). In addition, there is a need for control and coordination of the rib deployments so that none of them reach full deployment perceptibly later than the rest; thus being forced to provide a disproportional share of the torque required to preload the mesh and the net.

The functions of the apparatuses and methods described herein are to provide a deployable/collapsible mesh reflector capable of approximating a "shaped reflector" surface which may include regions of reversed (negative) curvature.

An exemplary embodiment of the disclosure is an umbrella-style deployable mesh reflector with integral foldable resilient hinges.

The features, functions, and advantages can be achieved independently in various embodiments of the present disclosure or may be combined in yet other embodiments.

DETAILED DESCRIPTION

Figure 1:
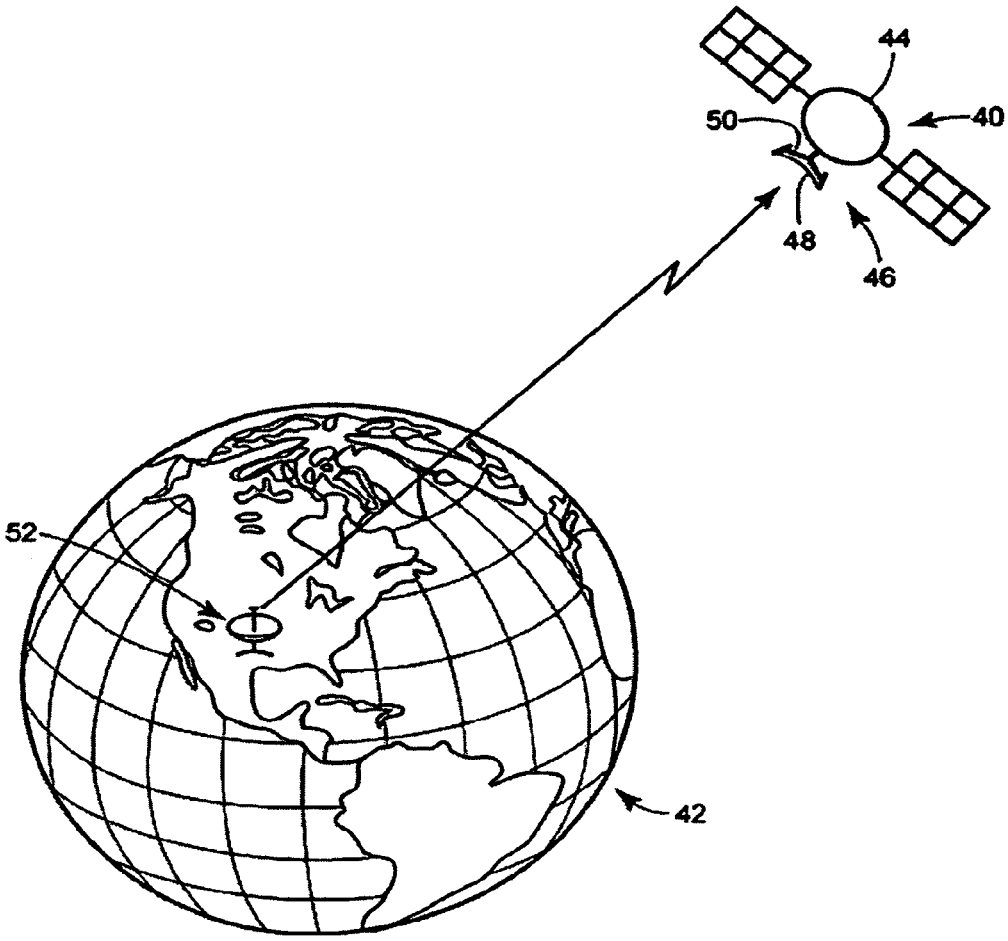
FIG. 1 is a perspective view of a satellite that includes a deployable reflector in orbit about the earth.

In FIG. 1, a perspective view of a satellite 40 in orbit about the earth 42 is illustrated. The satellite 40 itself includes both a body 44 and a deployable mesh reflector type antenna 46 mounted thereon. The deployable antenna 46, in turn, includes both a reflective mesh 48 and a supportive framework 50 for deploying and suspending the mesh 48. In having the deployable antenna 46 onboard, the satellite 40 is able to send and receive electromagnetic waves for thereby communicating with, for example, a ground communications station 52 while the satellite 40 is in orbit in outer space.

Figure 2:
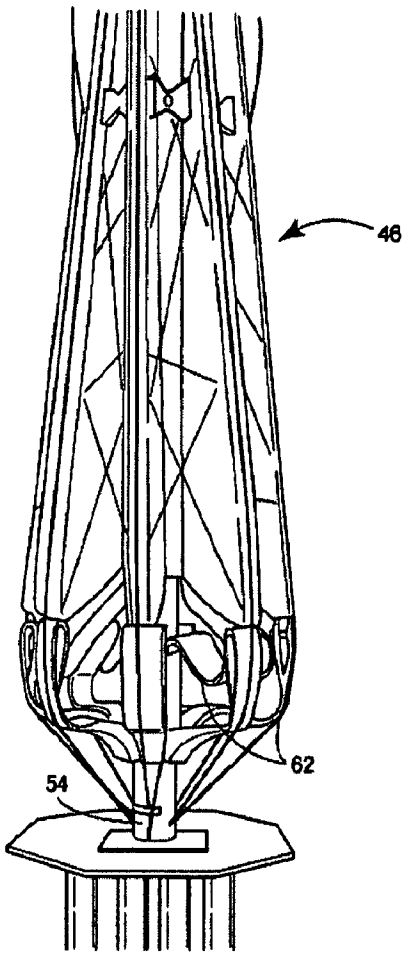
FIG. 2 is a diagrammatic perspective view taken from the side showing a deployable reflector in a stowed configuration.
Figure 3:
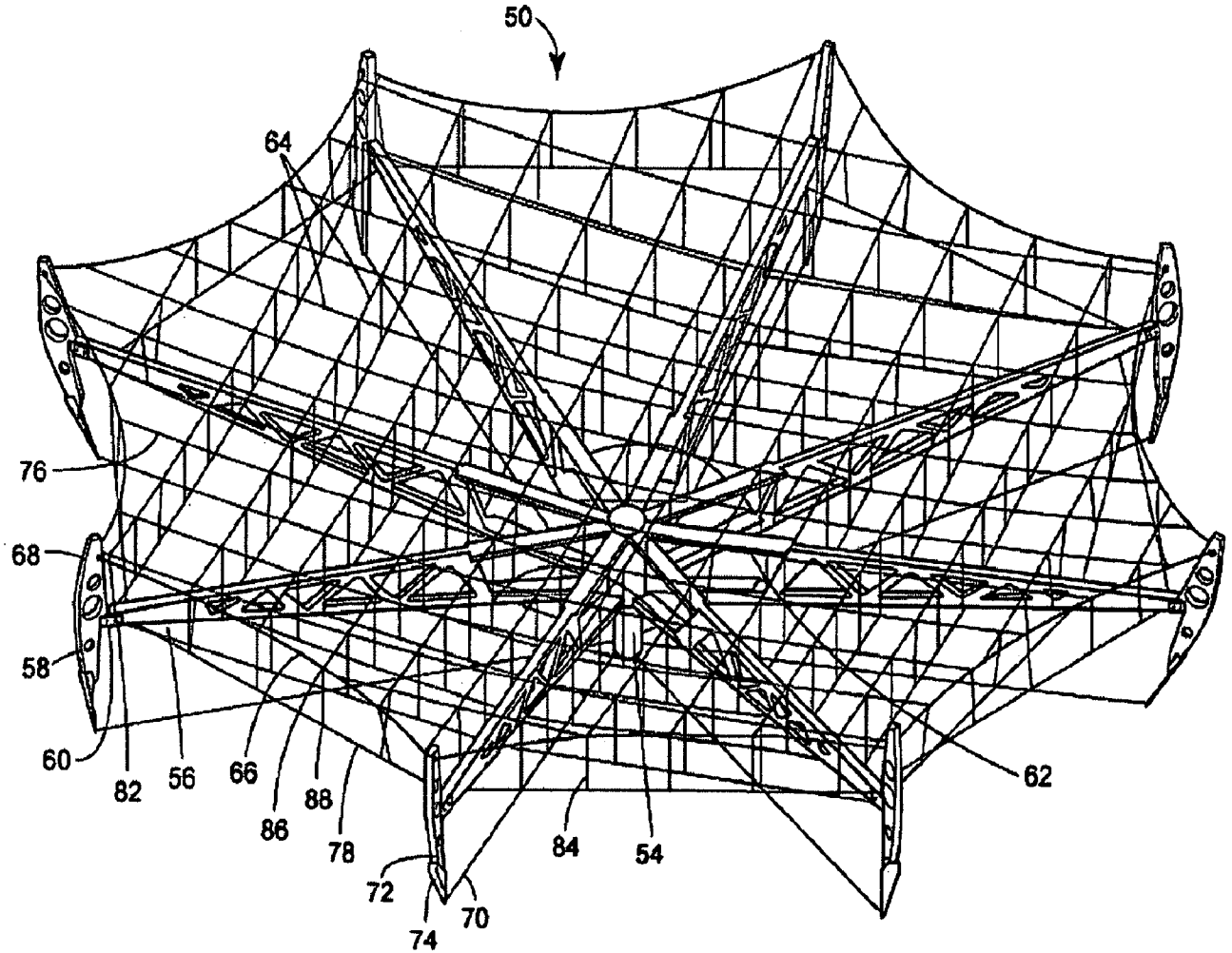
FIG. 3 is a diagrammatic perspective view of structural components that shape and form a reflector surface.
Figure 4:
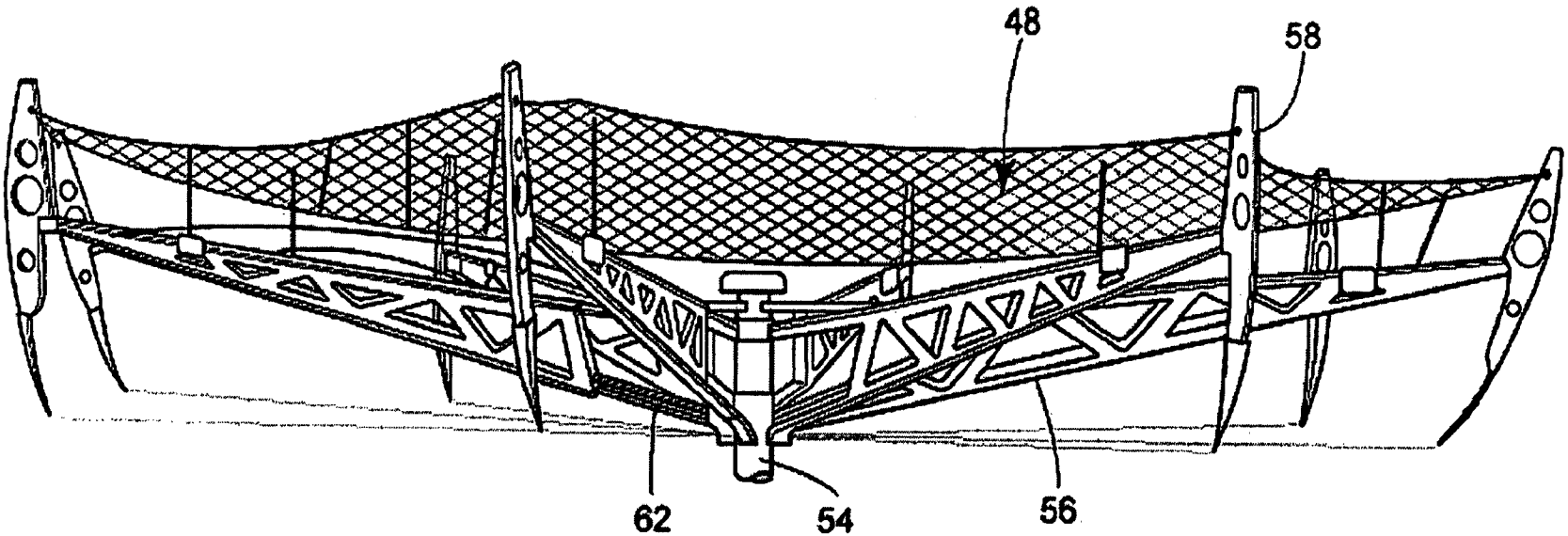
FIG. 4 is a diagrammatic perspective view taken from the side of a deployable reflector.

The reflector 46 is shown in FIG. 2 in a stowed configuration and in FIGS. 3 and 4 in a deployed configuration.

The reflector support structure comprises a slender composite hub 54 carrying eight radial ribs 56 with eight pivot arms 58, each mounted at a tip 60 of a rib 56. Each rib 56 may have a cross-section at the inner end having a substantially longer dimension in an axial direction in comparison with its dimension in the circumferential direction. The ribs 56 may be attached to the hub 54 via foldable multi-layered "carpenter's tape" composite hinges 62.

The reflective mesh 48 may be knitted out of Gold-plated Molybdenum wire, and may be tensioned and sewn to a net 64 made of relatively stiff thermally and environmentally stable chords that may be braided out of Vectran.®. (a liquid crystal polymer) or Quartz fibers.

The net 64 may be attached to a set of outer catenaries 66 spanning between the upper ends 68 of the pivot arms 58. These catenaries 66 may be made out of heavier chords braided out of the same fibers as the net 64.

Tension may be provided to the net 64, and maintained substantially constant by a set of radial tensioners 70 connecting the hub 54 to lower ends 72 of the pivot arms 58 via composite flexures 74. The radial tensioners 70 may be made out of the same material as the outer catenaries 66.

The net chords 76 may be arranged to form a plurality of rectangular openings of equal or slightly varying sizes.

A set of aft reaction catenaries 78 may span between aft ends of the ribs 56 and connect to the ribs 56 via small composite flexures 82.

The reflective mesh 48 and the net 64 may be shaped by a set of drop ties 84 connecting the corners 86 of the net 64 to points 88 along the aft catenaries 78.

Figure 5:
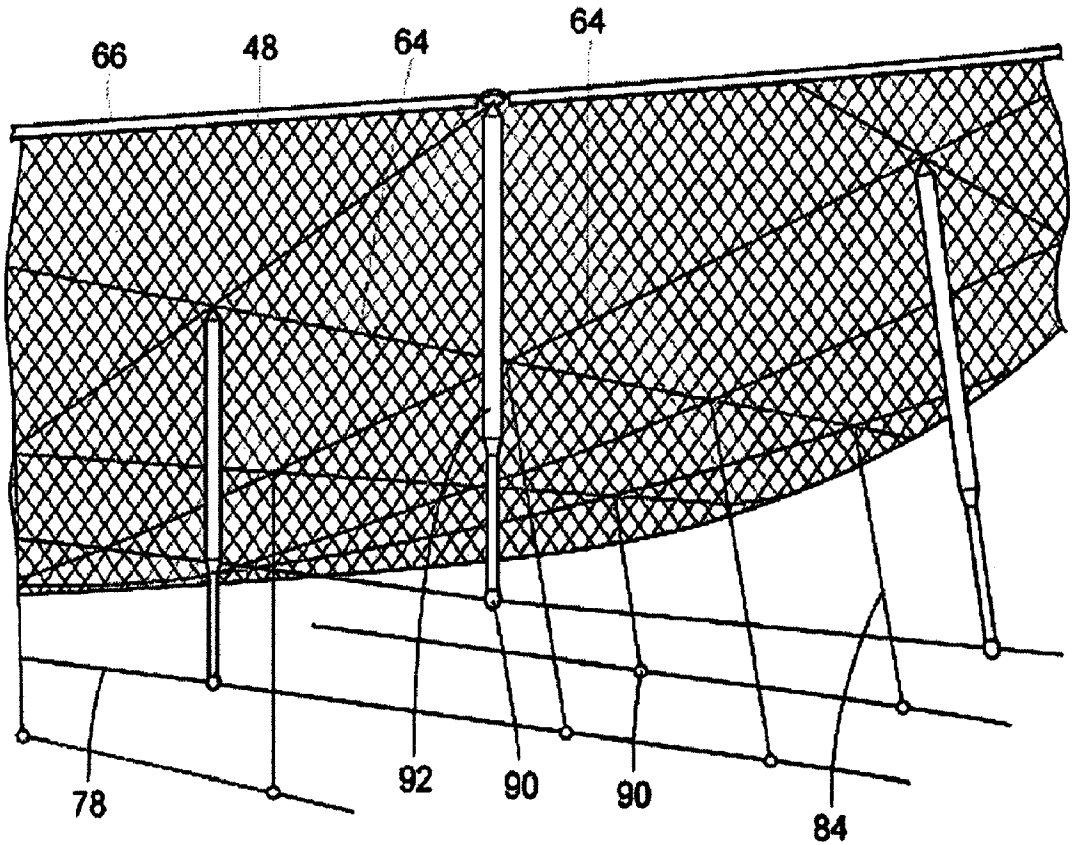
FIG. 5 is an enlarged diagrammatic perspective view of a portion of the reflector of FIG. 4.
Figure 6:
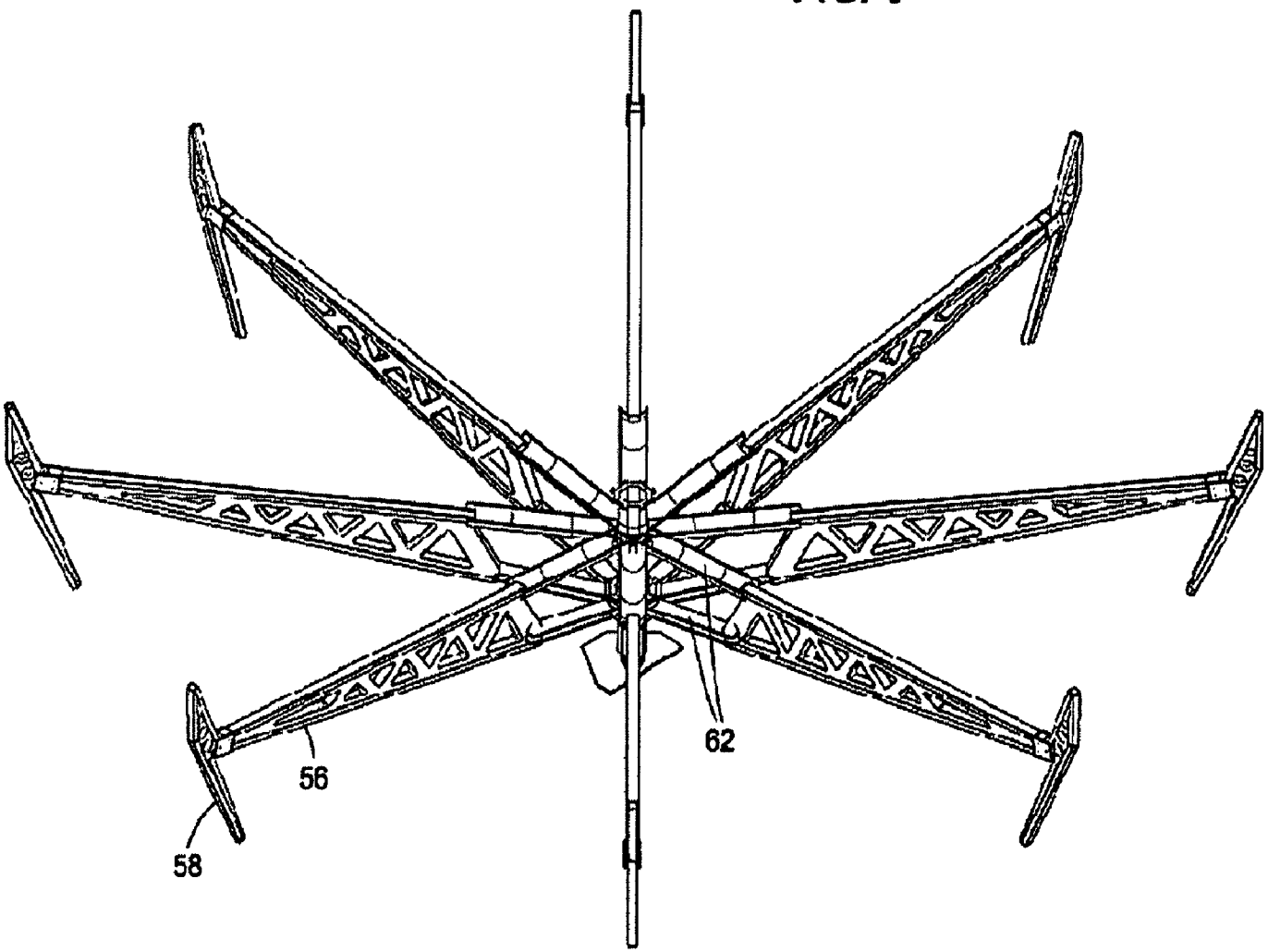
FIG. 6 is a diagrammatic perspective view showing the backing or supporting structure of a deployable reflector.
Figure 7:
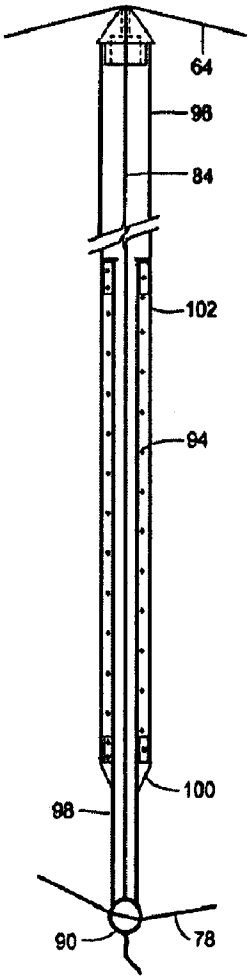
FIG. 7 is a cross-sectional view of a compression rod that may be used to maintain a reflector surface in a desired shape.

The drop ties 84 may attach to the aft catenaries 78 via small smooth beads 90 (FIGS. 5 and 7) through the use of a patented adjustable knot, permitting easy and precise adjustment of their length in order to shape the surface of the reflective mesh 48 (See, U.S. Pat. No. 6,030,007, the entirety of which is hereby incorporated by reference herein). The drop ties 84 may be made of the same material as the net chords 76.

Where the desired surface shape requires the drop ties 84 to push up on the surface, compression-rods 92 (shown in further detail in FIG. 7) may be used.

Each compression rod 92 may include a spring 94 that may be disposed between an outer tube 96 and an inner tube 98 that may be separated by electrically insulating bushings 100 and 102, that may be made from a plastic material, such as UItem 1000, available from GE Plastics. A tension-capable elongate member such as a drop tie 84 may extend through the center of the compression rod 92 and may be used to attach it to the aft catenaries 78 via small smooth beads 90 through the use of the patented adjustable knot mentioned above. The knot will provide easy and precise adjustment for the length of the compression rod 92.

In order for the compression rod 92 to be free of PIM; it should not permit casual metal-to-metal contact between its components. Therefore, it is preferable that the spring 94 be a tension helical spring which may be terminated by threading it over deep thread-like grooves in the bushings 100 and 102. The springs 94 may be chosen to loosely fit in the clearance between the inner and outer tubes 96 and 98. As long as the drop tie 84 extending through the center of the compression rod 92 is sufficiently shortened to cause the spring 94 to stretch, there will be no metal-to-metal contact, and the compression rod 92 will be PIM free. The compression rods 92 need not be manufactured out of a thermally stable material (and thus can be made out of any suitable metal or plastic material), since the stiffness of the drop ties 84 much exceeds that of the springs 94 within the compression rods 92; thus the low Thermal Expansion Coefficient (CTE) of the drop tie material dominates their behavior.

Figure 8:
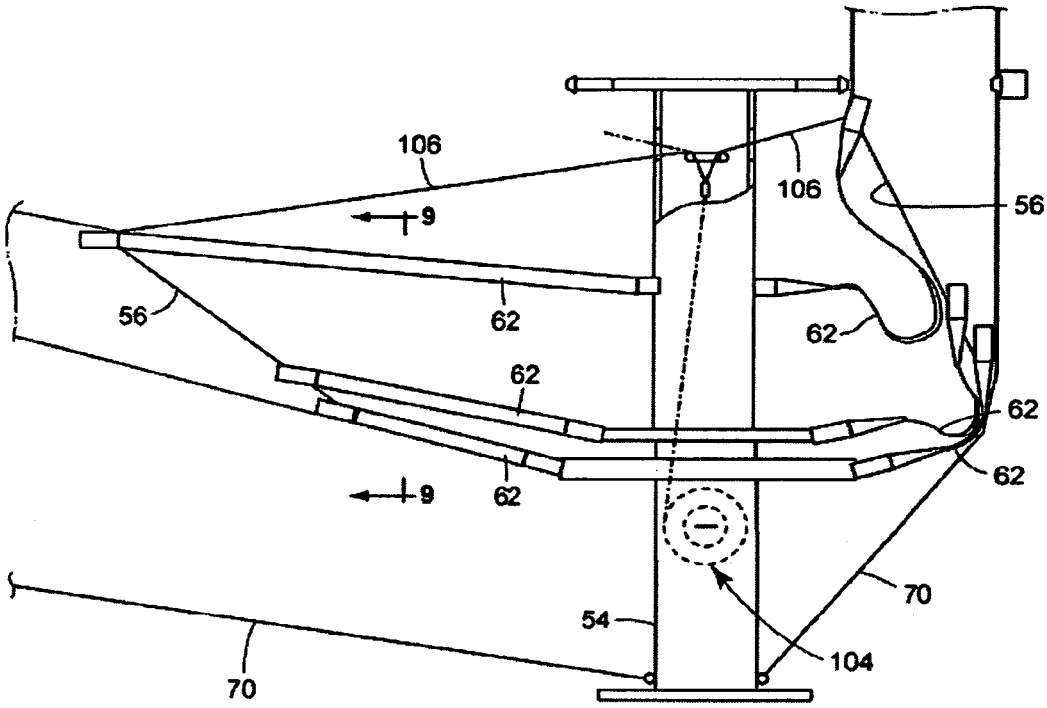
FIG. 8 is a schematic view taken from the side showing a restraint and coordination mechanism for a deployable reflector.

A central mechanism 104 may be located within the reflector hub 54 (see FIG. 8). The mechanism 104 provides drag force/torque during the rib deployment. Examples of devices that could serve as the mechanism 104 include eddy-current dampers; magnetic-particle dampers; viscous dampers; friction dampers; and electric motors (e.g., stepper motors and/or DC motors) with appropriate reduction gear-heads.

The central mechanism 104 may be attached to each of the ribs 56 via a flexible member (lanyard) 106 such as a strap or a chord. The lanyards 106 may be arranged such that they have equal lengths at all times during the deployment of the ribs 56.

In order to provide arbitrary shaping capability for the reflective mesh 48 (i.e., without limitation as to the direction of curvature) tension-only members (e.g., drop ties 84) and tension/compression capable members (e.g., compression rods 92 that surround drop ties 84) may be used for shaping the mesh. The latter being used in locations where the desired surface shape may involve negative curvature; thus requiring a compressive force. The length of both the tension-only and the tension/compression members can be easily adjusted in fine increments via the use of the aforementioned patented knot through the beads 90. In prior art reflectors (e.g., Type 2 reflectors), intricate adjustment hardware (e.g. threaded fasteners, swivels, etc.) is used for drop-tie length adjustment, posing hang-up risk and contributing to increased cost, mass, and deployment hang-up risk.

In order to avoid the possibility of instability of the system of compression rods 92 and chords 76 connected to them, the top ends of each of the compression rods 92 (those on the side to which the mesh is attached) may be stabilized by chords 76 extending in two different directions (nearly perpendicular to each other in this embodiment). This is unlike the radial-rib and folding-rib reflectors which have chords extending in two directions (radial and circumferential) only at certain points, with the majority of the points having only circumferential chords.

Figure 10:
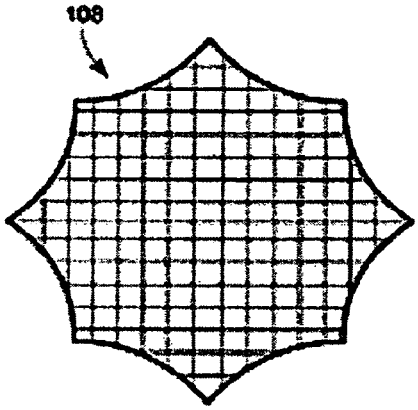
FIG. 10 is a plan view of a configuration of a net structure for a faceted reflector having a plurality of square-shaped regions.
Figure 11:
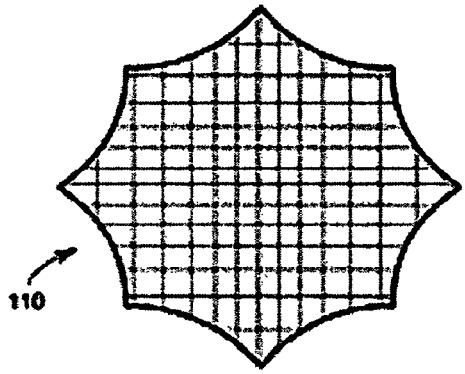
FIG. 11 is a plan view of a net structure for a faceted reflector having a plurality of variable-sized rectangularly-shaped regions.
Figure 12:
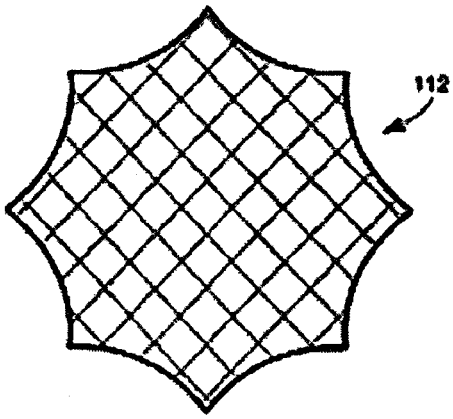
FIG. 12 is a plan view of a net structure for a faceted reflector having a geometry that includes a plurality of rhombus-shaped regions.
Figure 13:
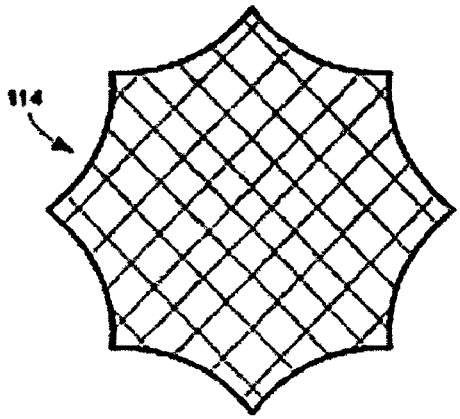
FIG. 13 is a plan view of a net structure for a faceted reflector that 10 includes a plurality of variable sized parallelogram-shaped regions.

All of the surface chords may essentially extend in one of two basic directions (except for the outer perimeter members which form a polygon and extend in a nearly circumferential direction). In one embodiment, the chords 76 form a net 108 with substantially square openings (FIG. 10). In another embodiment, they form a net 110 having rectangular openings of varying sizes (FIG. 11). In a third embodiment, they form a net 112 having rhombus-shaped openings (FIG. 12). In the most general case, the chords 76 form a net 114 having parallelogram-shaped openings of varying sizes (FIG. 13).

In addition to providing stability for the top ends of the compression rods 92, this style net offers several advantages:

In order to control the "pillowing" error, the tension in the chords 76 has to exceed a certain minimum level. On the other hand, excessive chord tensions results in increased deployment forces and structural loads with corresponding increases in mass and deployment risk. As a result, a good reflector design requires the ability to control the tension in each chord segment 76 as well as the ability to measure that tension, and to maintain a certain minimum tension though the life of the reflector 48. Since the net chords 76 may remain substantially straight as they go through each intersection, and since there are only two chords 76 at each intersection, it can be shown through a study of equilibrium at a typical intersection, that the load in each chord 76 remains substantially unchanged as it traverses across the entire reflector surface. Thus, all that is needed for adjusting and measuring the tension over the entire chord net 64, is a provision at one end of each chord 76 for such adjustment, and one measurement taken at one span anywhere along each chord 76.

Beads 90 and adjustable knots (similar to those used with the drop ties) may be provided at the ends of each of the net chords 76, and may be used to connect it to the outer catenary chord 66, and to adjust its length and tension level.

In addition to the great reduction in the number of adjustment provisions and flexible members needed in accordance with this disclosure, all of those provisions can be kept outside of the reflecting area. With the Type 2 reflectors, the need for adjustment provision and flexible elements within the interior of the reflector introduces complications and/or deterioration in surface accuracy. The current disclosure circumvents such complications.

In addition to minimizing the number of adjustment features, and to placing them conveniently outside the reflecting area, the current disclosure minimizes the number of individual chords needed to form and shape the reflector net. Since each chord has to be pre-conditioned, pre-measured, cut, labeled, inspected and tracked during the reflector manufacturing process, the reduction in the number of chords needed, significantly reduces the manufacturing cost of the reflector.

Since the length of each net chord depends to some extent upon the surface shape, and since the surface shape can vary somewhat during the surface adjustment process, the long continuous net chords of the current disclosure are very advantageous. These long and relatively flexible net chords can absorb the surface shape changes with minimal changes in the chord tension. With prior art net designs, a small change in shape can force re-adjustment of the individual chord segment lengths, if significant chord tension changes are to be avoided.

Figure 14:
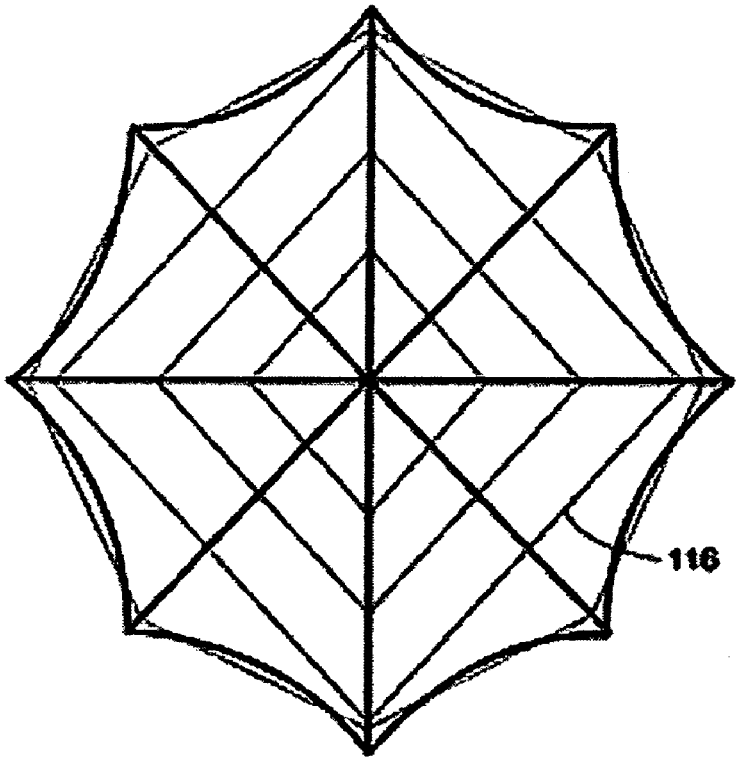
FIG. 14 is a plan view showing a portion of a structure for a deployable reflector that includes aft catenary chords in a "kite line" configuration.
Figure 15:
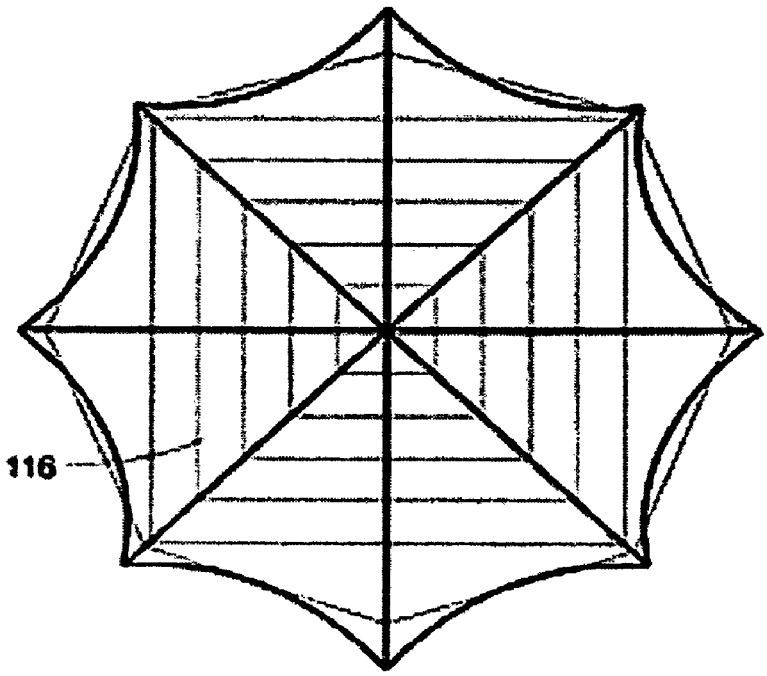
FIG. 15 is a plan view of a portion of a structure for a deployable reflector that includes aft catenary chords in a "clothesline" configuration.

In prior art mesh reflectors, the aft reaction net typically has the same geometry as the forward net (except for its depth). In the current disclosure, however, since the forward net has chords extending in two directions at each node (primarily to stabilize the compression elements) the aft net may be made of chords 116 extending only in one direction. The majority of the aft chords 116 extend in one of the two directions in which the forward net chords 76 extend (See FIGS. 14 and 15). Due to their shape, these aft chords 116 are referred to as the "clotheslines" (FIG. 15) or, in case of an elongated reflector, as the "kite lines" (FIG. 14). The chords 116 making up the clotheslines (or the kite lines) may attach to the backing structure ribs 56 via small attachment clips 118. Some of the shorter chords 116, however, may skip over some of the ribs 56 at which there is no change in their general directions. The fact that the aft chords may attach directly to the ribs 56 (and not to other chords) significantly reduces the interaction between the surface control points, making it much easier to adjust the surface geometry during manufacturing.

Figure 16:
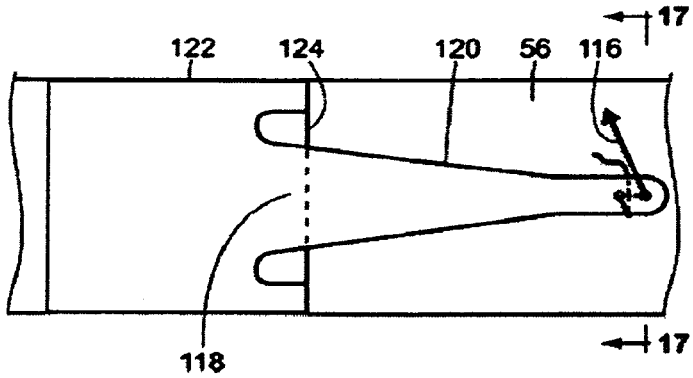
FIG. 16 is a side view of a flexure plate that may be used as a spring to maintain an aft catenary chord of a deployable reflector under constant tension.
Figure 17:
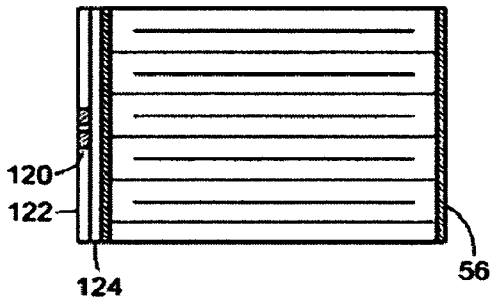
FIG. 17 is a cross-sectional view, taken along lines 17-17 of FIG. 16 of a flexure plate and a reflector rib.

The attachment clips 118 (FIGS. 16 and 17) may be small flexures machined out of composite (e.g., graphite-epoxy) plates. Each of these clips 118 has a tapered variable width cantilever section 120 and a U-shaped bonding section 122. The bonding section 122 may be bonded to the side of the reflector rib 56 through a spacer plate 124 (that also may be made out of a composite plate). Since there is a large difference in the magnitudes of loads between the inner row clothesline chords 116 (controlling the reflector mesh nodes) and the outer row of clothesline chords 116 (controlling the reflector outer perimeter catenaries), two different size chords may be used on the clotheslines.

Figure 18:
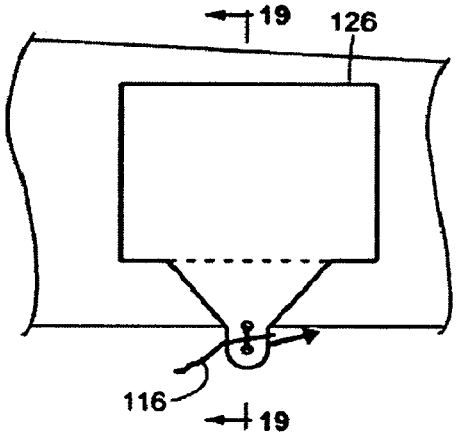
FIG. 18 is a side view of a heavy load flexure plate that may be used as a spring to maintain a heavily-loaded aft catenary chord of a deployable reflector under constant tension.
Figure 19:
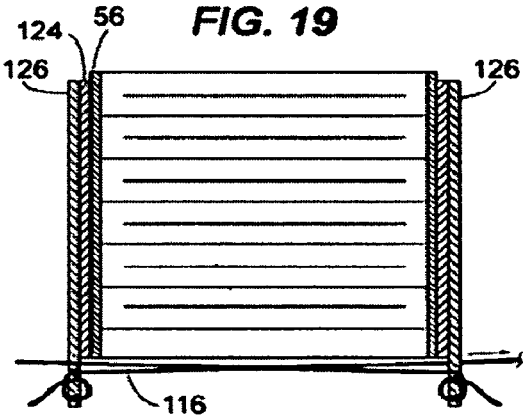
FIG. 19 is a cross-sectional view of the flexure plate and reflector rib 25 of FIG. 18, taken along lines 19-19 of FIG. 18.

Two different size (and orientation) flexures may also be used due to the large difference in loading. Accordingly, a heavy flexure clip 126 (FIGS. 18 and 19) may be placed on the far side of each rib 56 (relative to where the chord spans are) in order to reduce the tensile stresses in the bond between the face-sheet and the clip 126, and between the ribs' honeycomb cores and their face-sheets. The reason for the tapered width of the cantilever sections 120 and 128 is that it provides a bending stress which is nearly constant along the length of each cantilever sections 120 and 128, thus minimizing the weight and maximizing the flexibility of the flexure clips 118 and 126. Also, the reason for the U-shaped bonding section 122 is to minimize the peel stresses (for the light clip 118) which occur near the root of the cantilever section 122. Finally, the reasons for using a flexible clip to attach the chords to the ribs are:

in order to reduce the sensitivity of the tension in the aft catenary system to chord expansion/contraction (due to thermal expansion or creep) by ensuring that the pre-stretch in the system (the chord+the clip) is much larger than the chord expansion; and the deflection of the flexure provides a convenient means for measuring the tension in the chord, and for observing any change in the tension over time.

In prior art reflectors, the umbrella reflector ribs are typically made out of cylindrical tubes. Since the majority of the deployment load is in the plane perpendicular to the rib deployment hinge axis, with much less load/stiffness requirements in the plane containing the hinge axis, the ribs in the current disclosure are shaped as tapered trusses. The trusses may be cut out of honey-comb plates with composite (e.g. Graphite-Epoxy) face sheets. These trusses are much more efficient than cylindrical tubes in carrying the deployment load (bending moment) which gradually builds up from near zero at the rib outer end (where the truss depth is at a minimum) to its maximum value at the inner end of the rib. An added advantage to this rib design is that it permits the use of much deeper integral hinges (thus providing more deployment moment capability) without the need to increase the rib width (by increasing only the depth of the truss). In addition, with the reduced rib width, a smaller hub diameter may be used—thus reducing the hub mass and the overall diameter of the stowed reflector package.

Figure 9:
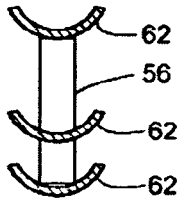
FIG. 9 is a cross-sectional view, taken along lines 9-9 of FIG. 8, showing a hinged structure for a deployable reflector.

In prior art reflectors, the resilient collapsible integral hinges are made of two sets of curved shells representing two opposite parts of a cylinder. In the current disclosure, the integral hinges 62 may be made of two (or more) sets of curved shells all of which face in the same direction (upwards, or towards the focus side) and may be spaced apart by an arbitrary distance in that same direction (see FIGS. 8 and 9). In prior art reflectors, due to symmetry, the hinge works equally efficiently whether it is bent up or down. In the current disclosure, however, since all the shells face in the same direction, the hinge 62 can be optimized to work more efficiently than the systematic hinge when bent in one direction (upwards), and less efficiently (or not work at all) in the opposite direction. Since the reflector ribs 56 only need to be bent in one direction for stowage, the asymmetric arrangement used in the hinges 62 is more efficient, and can provide more deployment torque/energy than the prior art's symmetric hinge for less hinge mass. The hinge performance and mass may be further optimized by varying the lengths of the sets of shells. This hinge design also makes it harder for the ribs 56 to bend backwards (back buckle) which is a condition that can seriously damage the reflector net and mesh.

In order for the reflector ribs 56 to move gradually during deployment, and to reach their fully deployed positions nearly simultaneously, each of them may be attached to the central mechanism 104 located at the hub of the reflector via the flexible members 106. The central mechanism 104 could be passive (such as an eddy-current, viscous, magnetic-particle, or friction damper), or active (such as an electric motor with a reduction gear-head). The central mechanism 104 slows down the deployment, thus avoiding large impacts at the end of the deployment stroke, which could otherwise damage the reflector net 64. It also causes the ribs 56 to reach their fully-deployed positions essentially simultaneously, so that all the ribs 56 will cooperate in tensioning the net and the catenaries. Should this not be effected, and one of the ribs 56 should lag behind the other ribs 56 even by a few degrees, it will end up bearing most of the pre-tensioning loads from the net 64 and catenaries 66 and 78 by itself. This could result in a deployment hang-up (if the rib does not have enough torque margin to tension the entire reflector 46) and/or over-stressing of the net chords 76, resulting in some loss of the surface accuracy or even physical damage to the chords 76.

With reference to FIGS. 20 through 25, mesh fabrication and mesh attachments will now be described.

For mesh fabrication, a suitable table (not shown), having a substantially flat light-weight top which is slightly larger than the size of the reflector 46 may be used. The table top may be reinforced with several structural beams and may be supported on a plurality of stands via a set of isolators. The table top may have smooth rounded edges and may be equipped with at least one vibratory device (e.g., a variable power and speed electric rotary vibrator).

In order to tension the reflective mesh 48 during fabrication, a plurality of small weights may be used (e.g., spaced only a few inches apart), each equipped with a chord and a hook adapted for connecting it to the mesh edge. The magnitudes of the weights and their spacing may be selected to provide the desired tension in the mesh.

Figure 20:
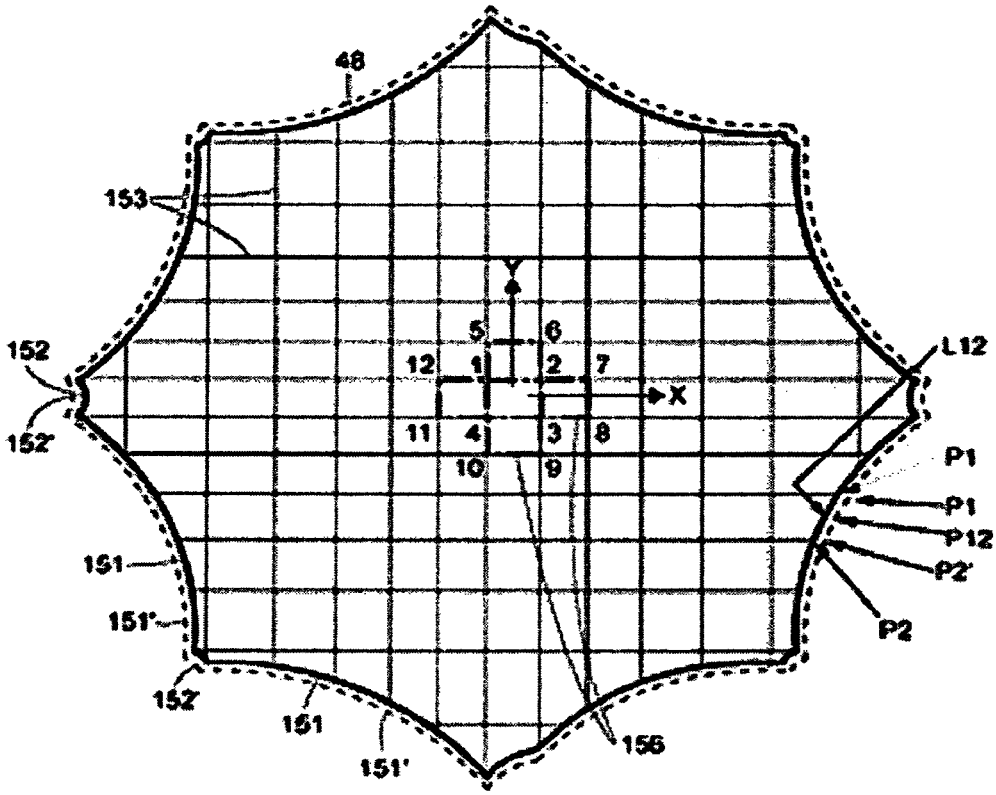
FIG. 20 is a diagrammatic plan view of a reflective mesh, superimposed on a flat pattern boundary that may be used to produce a flat pattern suitable for fabricating a mesh surface.
Figure 21:
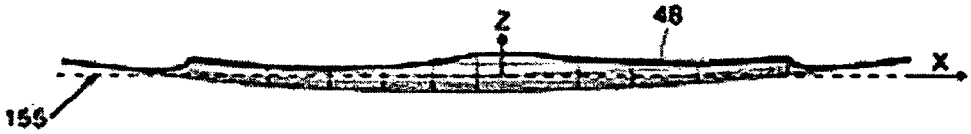
FIG. 21 is a diagrammatic side view of the reflective mesh of FIG. 20, superimposed on a best-fit plane that may be used to produce a flat pattern suitable for fabricating a mesh surface.

FIG. 20 depicts a typical mesh surface of a reflector having a moderately large F/D (F=nominal focal length, and D=nominal reflector diameter), that may be greater than 1.0. The surface may be bounded by eight relatively shallow longer catenaries 151 and eight relatively more curved shorter catenaries 152. The mesh 48 is represented as being attached to a rectangular net 153 which divides it into a plurality of nearly flat rectangular facets. Due to the relatively large F/D, the curvature of the mesh surface is relatively low as can be seen from its side view (FIG. 21).

Since it is desirable to fabricate the reflective mesh 48 on a flat table, and since the mesh material is inherently flat, a method for defining a flat-pattern boundary may be used in preparing the mesh, and will result in a mesh that meets the objectives previously mentioned. The method may be performed as follows:

1. Start with defining a plane 155 which best fits the desired reflector surface. The least square method or any other convenient method (even eye-balling) can be used in defining the plane 155.

2. Project the desired mesh surface including the vertical and horizontal net lines 153 on the best fit plane to determine an initial flat pattern. It is well known that the length of each of the projected line segments on this flat plane will be shorter than its true length. This includes all the long and short outer catenaries 151 and 152 as well as the net lines 153. As a result, if the reflective mesh 48 is fabricated according to this flat pattern, the reflective mesh 48 and its outer catenary edge treatments will have to be further stretched upon installation on the reflector. While the reflective mesh 48 itself is typically so soft that the additional stretching may only result in a moderate increase in its tension levels, the outer catenary edge treatment is typically significantly stiffer than the mesh, and stretching it can result in an undesirable increase in its tension levels.

3. Compute the approximate length of each of the long catenary lines 151 and the net lines 153 as the sum of the short nearly straight-line segments connecting the neighboring intersection points between the catenary lines and the net lines, or between the vertical and horizontal net lines. Similarly, compute the approximate lengths of the "projected" flat-pattern catenaries and net lines as the sums of the lengths of their segments projected on the best-fit plane. For example, with reference to FIG. 20, the length of the catenary line segment L12 connecting points P1 and P2 can be written as:

$$L12=[(X1-X2)^2+(Y1-Y2)^2+(Z1-Z2)^2]^{1/2}.$$

Similarly, the projected length of this line segment on the flat-pattern plane PL12 can be written as:

$$PL12=[(X1-X2)^2+(Y1-Y2)^2]^{1/2}$$

As mentioned above, the length of each of the projected flat-pattern lines will be slightly shorter than its corresponding 3-D line (which is evident since the positive term $(Z1-Z2)^2$ is missing from the equation for PL12.)

4. In order to avoid the need to stretch the catenary edge treatment, and to reduce the amount of additional strain in the mesh, upon installation on the reflectors' net, the points defining the edges of the flat pattern are perturbed by moving them slightly outwards. For example, the projected flat pattern points P1 and P2 are moved to the positions P1' and P2'. It is recommended that the points be moved approximately in the radial direction (relative to the center of the mesh surface). There is not a unique solution for this problem, but the magnitude of the movements needs to satisfy the following criteria:

i. The 3-D length of each of the longer catenaries 151 is equal to, or is slightly longer than, the length of its flat-pattern 151'. One way this can be achieved is by ensuring that the 3-D length of each of the segments (such as L12) equals that of the corresponding projected length after the movement (PL1'2').

ii. The 3-D length of each of the shorter catenaries 152 is slightly longer (by less than 3%) than the length of its flat pattern 152'. Since these short catenaries are more curved, they can stretch slightly upon installation under relatively low tensions by reducing their curvatures. This will result in a slightly increased mesh tension locally, which will tend to stabilize the shape of these curved short catenaries.

iii. The 3-D length of each of the vertical and horizontal net lines is longer than the length of its perturbed flat patterns. This can be achieved by computing the length of each of these lines (starting at its point of intersection with the coordinate plane XZ or YZ, and ending at its point of intersection with the outer catenary) by adding the lengths of its constituent approximately straight segments, and ensuring that the modified X' coordinate of its end point (in case of a horizontal net line), or the modified Y' coordinate of its end point (in the case of a vertical net line) is less than that computed length. For example, the length of the horizontal net line ending at point (P1) should be greater than the absolute value of the coordinate X1' of the modified point (P1').

5. Draw the flat pattern for the 5 innermost net cells 156, but decrease the X and Y dimensions of the projected cells by the ratio by which the true length of each of the vertical and horizontal chords associated with these 5 cells (i.e. the 4 innermost horizontal and vertical net chords) exceeds its final length on the perturbed flat pattern.

6. Prepare a full-scale plot of the flat pattern, e.g., on a Mylar film. The plot may include, in addition to the modified position for the inner cells, two sets of concentric lines representing the outer boundaries of the mesh. One of these sets is to represent the desired nominal finished mesh boundary. This line should extend slightly in-board of the nominal reflector net boundary (e.g., by about 0.3"). The second set of lines should extend outboard of the first set, offset from it by a constant distance (e.g., 0.3"). This second set of lines is where the mesh is to be cut. Additionally, the plot should include markings indicating the intersections of the vertical and horizontal net lines with the mesh boundaries (e.g. points P1' and P2' in FIG. 20). Alternatively, instead of plotting the flat pattern on a Mylar film, a special computer-driven overhead projector could be used to project a full scale image of the flat pattern onto the mesh table.

The material to be used for fabricating mesh edge treatment strips 160 (FIGS. 22-25) should have certain properties. It should be light weight and thermally stable (having a low CTE). It also should be significantly stiffer than the mesh material, yet much more flexible than the net catenary chord material. Finally, its electrical resistivity should be high enough to prevent PIM, yet low enough to avoid being an ESD threat.

These requirements can be satisfied by a composite material made up of Kevlar fabric (e.g., 120 style cloth) impregnated with a Silicone RTV resin which may be doped with fine graphite particles (e.g., CV2-1148). To minimize the mass and CTE, the minimum amount of resin sufficient to thoroughly wet the fabric is to be used, with all the excess resin squeezed away (e.g., using a spatula). After curing for at least 24 hours (at room temperature and at least 30% relative humidity) the material may be cut into strips of the appropriate width at the +/−45° direction (relative to the warp and fill directions of the cloth). This provides for strips of sufficiently high strength yet very low CTE and sufficiently low stiffness.

If desired, the above composite material could be made out of quartz or graphite fibers. It could also contain multiple layers of balanced or non-balanced fabric laminated in angles in the range of ±30° to ±60°, tailored in order to achieve the desired balance of low CTE and low stiffness.

Figure 22:
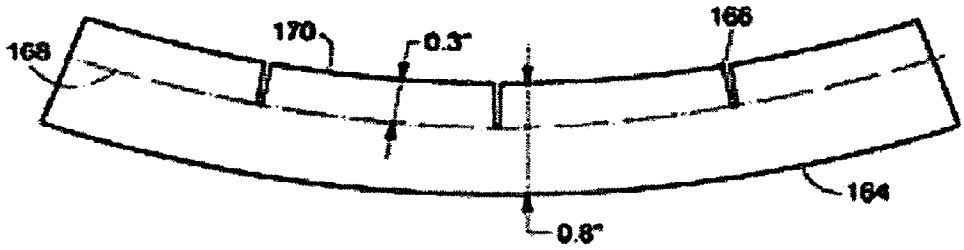
FIG. 22 is a diagrammatic plan view of a mesh edge treatment member in an unfolded configuration.
Figure 23:
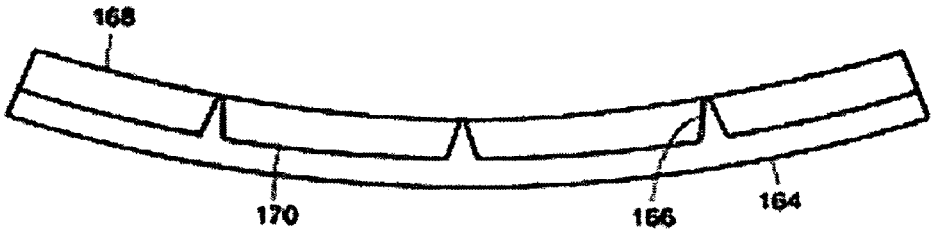
FIG. 23 is a diagrammatic plan view of the mesh edge treatment member of FIG. 22 in a folded configuration.

Long edge treatment members 162 (FIG. 24) are typically of sufficiently low curvature that they can be cut as straight strips. Each of these members requires one continuous strip (approximately 0.8" wide for members up to 100" long) and several shorter strips approximately 1.3" wide. The short edge treatment members 164 may be sufficiently curved that they have to be cut as curved members. Since these curved strips are to be folded over themselves, it may be necessary to "dart" the outer edges of these strips at one or more places 166 in order to facilitate folding them (e.g., radially slitting the outer edges 170 every few inches as shown in FIG. 22, which depicts a typical flat pattern for fabricating one such strip 164).

In order to facilitate mesh edge finishing, the long and short 0.8" wide strips may be folded length-wise along a fold line 168, creased, and may be stored folded until they are ready for installation on the mesh. The fold line 168 may be about 0.3" from the outer edge 170 of the strip (see FIGS. 22 and 23 for a typical short strip 164). The long strips 162 may be similar but straight.

Install the flat pattern full-scale plot(s) on the mesh table. If the plot is made of more than one segment (due to plotter or film width limitations), then carefully align the segments relative to each other and to the edges of the table. Securely attach the plots to the table. Strips of transparent non-bondable film may be securely installed over the mesh boundaries plotted on the flat-pattern film.

Cut a square piece of mesh material sufficiently large to cover the mesh flat pattern and extend at least several inches in each direction, then lay it face-down over the flat pattern on the mesh table. Attach the weights, using the hooks, near the edges of the mesh, extending the chords over the rounded table edges (or over rollers around the table edges if the table is so equipped) and allowing the weights to hang freely around the table edges. Use the table vibrators to break the friction between the table and the mesh/weights to ensure uniform mesh tension. Adjust the spacing between the weights (as often as necessary) to maintain the proper tension levels in the mesh. Secure the mesh to the table using appropriate means (e.g. pressure sensitive adhesive (PSA) tape, weights, or magnetic strips).

Carefully mark the location of the five central net squares (156) onto the mesh material using appropriate marking means. One possible means is to use a colored thread (and a curved needle) to temporarily mark the boundaries of those squares using a fairly course stitch (approximately 1" pitch). The thread may be removed after the mesh is installed on the reflector.

The process of applying edge treatment and finishing the mesh edges involves several steps:

First, bond the long edge treatment strips 162 to the reflective mesh 48, e.g., using the same silicone RTV used to impregnate the Kevlar utilized for making the strips 162 and 164. Use just enough adhesive to avoid excessive squeeze out (when pressure is applied to the strips during bonding) yet ensure that at least some adhesive squeezes out every where along the entire outer edge of the strip 162 in order to encapsulate the reflective mesh 48 and minimize any mesh wire motion when it is cut along the outer edges of the strips 162. When the strips 162 are being bonded to the mesh, they should be carefully aligned so that their outer edges are located along the outer set of the two sets of lines on the flat pattern plot 151' representing the outer mesh boundary. The adhesive should be allowed to cure for at least 16 hours.

Second, use a sharp knife to cut the mesh along the outside edge of one of the edge treatment strips 162. Then, fold the strip 162 (with the mesh attached to it) along the previously set crease line and re-set the crease along the entire strip. Apply a thin bead of the silicone RTV adhesive along the inside of the crease, using just enough adhesive to bond the folded strip 162 to itself, but avoid excessive squeeze-out as pressure is applied on top of the folded strip 162 during curing. Repeat the process for the remaining (seven) long edge strips 162, and then let the adhesive cure for 16 hours.

Third, after bonding and folding of the (eight) long strips 162, repeat the first step above to bond the (eight) short strips 164 and let them cure as before. The short strips 164 may overlap the folded long strips (as shown in FIG. 24).

Figure 24:
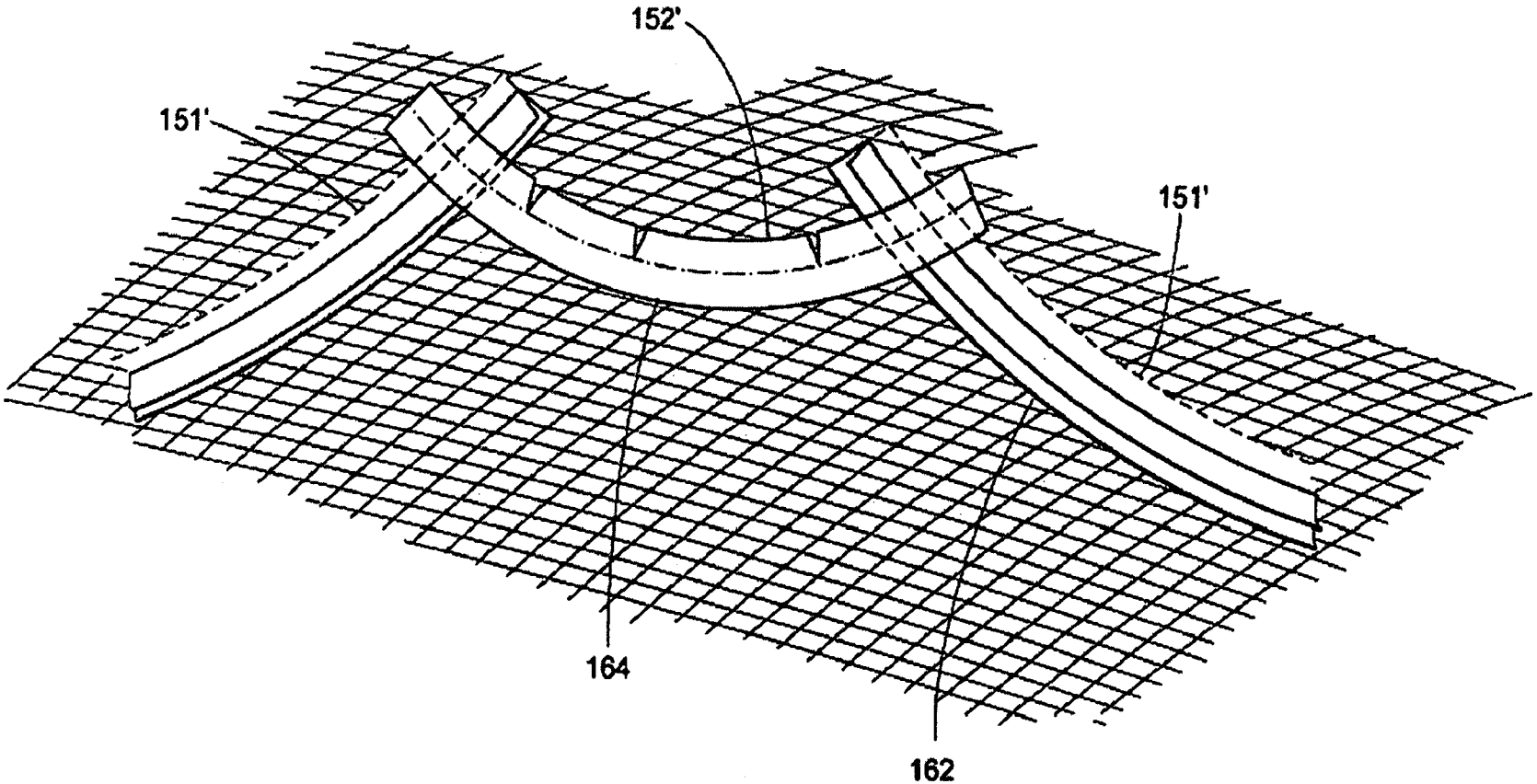
FIG. 24 is a diagrammatic perspective view of a group of three contiguous mesh edge treatment members.

Fourth, use a sharp (Kevlar cutting) knife to cut the mesh along the outer edges of the short strips 164 as well as the excess length of the short and folded up long edge strips (as shown in FIG. 24). Then, fold the short strips 164 (with the reflective mesh 48 attached to them) along the pre-creased fold lines 168, re-setting the crease lines and bonding the folded strips to themselves as in step 2.

Figure 25:
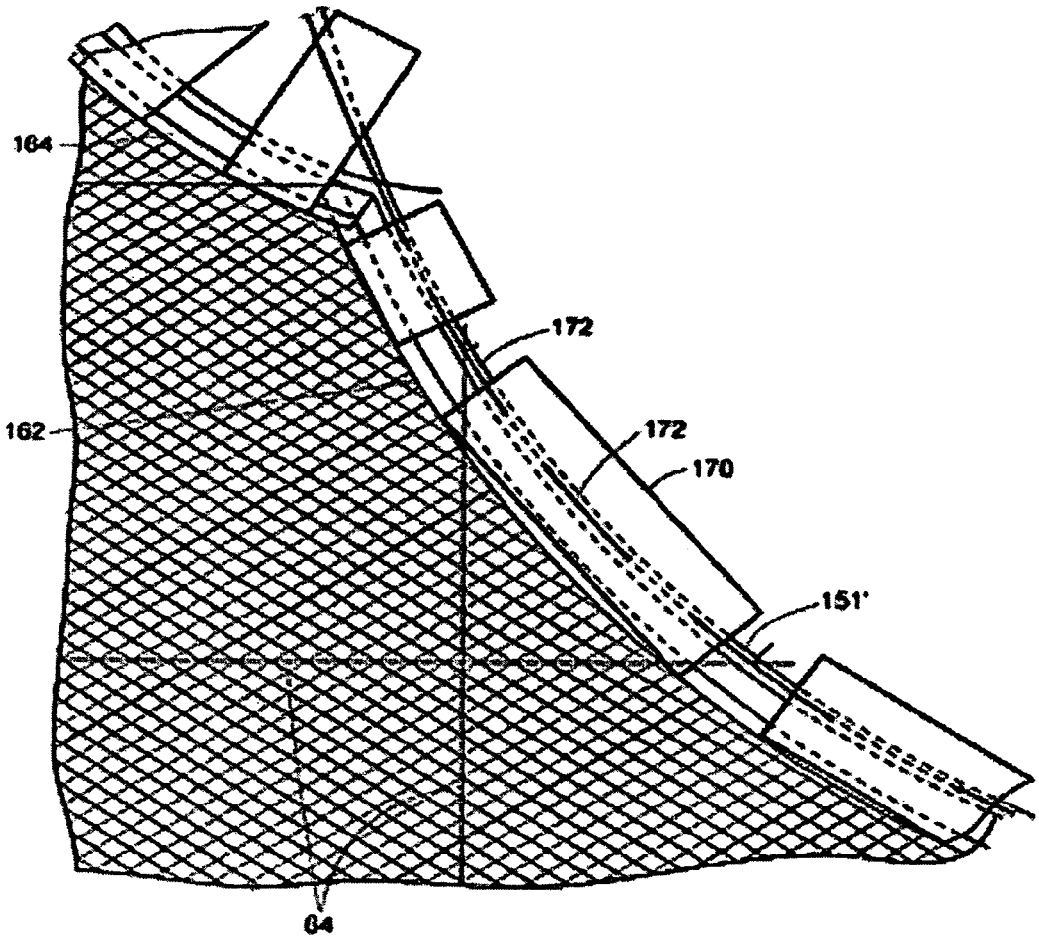
FIG. 25 is a diagrammatic plan view of mesh edge treatment members attached to a portion of a mesh surface.

Fifth, use wide edge treatment strips to cut tabs 170 to length for each mesh boundary line segment between its intersections with the vertical and horizontal flat pattern net lines, leaving at least a ½" gap to each intersection point (see FIG. 25). Also, cut approximately 3" long pieces of the wide strip and place them perpendicular to the short edge treatment strips spaced about 1" apart. Bond the wide strip tabs 170 over the folded long and short strips 162 and 164 using the silicone RTV adhesive.

For mesh attachment the mesh may be suspended over the reflector net 64 as follows:

Temporary handling chords 172 (for example, 8 of them) may be sewn to the wide edge-treatment tabs 170 just outside of the folded long edge strips 162 (see FIG. 25). These handling chords 172 may be attached to a light-weight handling frame (not shown, which may be slightly larger than the reflector size) and used to lift the reflecting mesh 48 off the mesh table, turn it right side up (since it is fabricated up-side down on the mesh table) and place it over the reflector net 64 close to its final position Next, the handling chords 172 may be disconnected one-by-one from the handling frame, and may be connected to the upper ends 68 of the pivot arms 58 as close as possible to the locations to which the corresponding net outer catenaries 66 are attached.

Based upon the outer catenary aspect ratios (camber to length) and upon the desired tension level in the reflecting mesh 48, the approximate tension level in the mesh edge closure strips 162 and 164 (typically a few pounds) may be computed. The handling chords 172 may be tensioned to levels slightly higher than the computed levels (in order to account for the effect of the mesh curvature and 1-G loading). This should bring the mesh edge closing strips to lie close to the outer catenaries 66.

In order to attach the reflecting mesh 48 to the net 64, first verify that the folded long mesh edge strips 162 extend approximately parallel to the net outer catenaries 66 and inboard of them by approximately the nominal design distance (0.3"), adjusted for any known deviations from nominal in the positions of those catenaries 66. If not, attempt to improve the situation by adjusting the tension in the handling chords 172 and/or adjusting the locations of the attachment points of the handling chords 172 to the structure. Also, verify that there are no wrinkles in any of the edge strips 162 and 164 and that the edge treatment tabs sit over the net catenaries extending between ¼ and /3;4 inches outboard of them.

Next, fold the tabs 170 over the corresponding net outer catenaries 66 using some temporary means for holding them (e.g. small alligator clips). After temporarily securing the entire perimeter, verify that the mesh edges are still wrinkle-free adjusting the tab folding as necessary.

The next step is to sew the reflecting mesh 48 to the center of the net 64. One convenient technique is to apply some light distributed weights such that the reflecting mesh 48 is stretched and comes in contact with the net 64. (This may not be necessary if the reflecting mesh 48 is sufficiently large and the surface sufficiently shallow that the mesh center contacts the net 64 due to its own weight alone). If the markings at the center of the reflecting mesh 48 do not closely line up with the corresponding net chords 76, attempt to correct the situation by applying lateral loads (which are small relative to the specified mesh tension) to the mesh. Otherwise, readjust the perimeter tabs temporary attachments/tensions until the center mesh markings are brought sufficiently close to the net chords 76. Then sew the reflecting mesh 48 to the net chords 76 using suitable stable sewing thread, e.g., Kevlar or Quartz thread, and a curved needle. All five central squares 156 (FIG. 20) can by sewn using one continuous piece of thread if the sewing is started and finished at one of the four central corners. One possibility is to do the sewing in the sequence shown in FIG. 20 (the sequence is: 1, 2, 3, 4, 1, 5, 6, 2, 7, 8, 3, 9, 10, 4, 11, 12, 1).

Afterwards, sew the tabs 170 to the outer catenaries 66 using a strong low CTE sewing thread (e.g. Vectran or Kevlar) and utilizing appropriate knots at the beginning, middle and end of each tab 170 such that the tabs 170 may be both laterally and axially (i.e., normal to, and along the direction of the outer catenaries) secured to the outer catenaries 66 at their mid-points and at least laterally secured to them along the rest of their length.

After the sewing is completed, remove the handling chords 172, trim the width of any folds of the tabs 170 which may be wider than ½ inch, then apply a small continuous bead of the RTV adhesive to the free edges of each tab 170, securing them to their own undersides. This will eliminate the chance of having any chords such as 76, 78 or 84 hang up on the tabs 170.

Finally, the reflecting mesh 48 may be sewn to the rest of the net chords 76 starting at the outer catenaries 66 and following each net chord 76 to the center of the reflector or to the opposite outer catenary 66.

With regard to mesh fabrication, the design of the Kevlar/RTV composite material used to fabricate the edge strips 162 and 164 meets both the mechanical and electrical requirements for the edge treatment because:

1) Use of Silicone RTV as the matrix provides for both the low stiffness and low CTE requirements due to its inherently low stiffness in comparison with that of the Kevlar fibers. 2) The +/−45 degree fiber orientation of the Kevlar 120 fabric minimizes the CTE (provides the same CTE as a 0/90 degree fiber orientation) while minimizing the axial stiffness (typically only a few times higher than the stiffness of the matrix material—RTV). 3) The dielectric properties of the organic Kevlar fibers and the silicone matrix material coupled with the controlled Graphite powder doping produces bulk resistivity well within the range of $10^4$ to $10^9$ Ohm-cm which is safe for both ESD and PIM.

The process for trimming the mesh immediately next to the outside edge of the edge strips 162 and 164 (within the RTV adhesive fillet) ensures that the mesh wires are stabilized by being encapsulated by the RTV. This minimizes the opportunity for fraying or unraveling of the mesh edges, and for the free wire edges contacting each other—thus minimizing the associated PIM risks.

The geometry for folding, and overlapping the long and short edge strips 162 and 164 is designed to minimize PIM effects: 1) The edge strips 162 and 164 may be folded backwards over themselves such that the trimmed free edges of the reflecting mesh 48 (which may include some weak PIM sources) are shielded from being within line-of-sight of the antenna feed horn(s) (not shown) by the mesh itself. 2) The width of the folded portion of the edge strips 162 and 164 (0.3") is narrower than the width of the portion of the strips 162 and 164 remaining flat (0.8−0.3=0.5"). Thus, after folding, the cut free edge of the reflecting mesh 48 cannot contact the portion of the reflecting mesh 48 inboard of the edge strips 162 and 164. Had the edge strips 162 and 164 been folded in half (nominally) the possibility of the cut free edge of the reflecting mesh 48 touching the portion of the reflecting mesh 48 inboard of the strips 162 and 164 (under certain tolerance conditions) possibly causing it to generate PIM in the line-of-sight of the antenna feed horn(s) would have existed. 3) The process sequence of bonding and folding of the long edge strips 162, bonding the short strips 164 on top of them, trimming of the edge strips 162 and 164, then folding the short strips 164, precludes the possibility of introducing PIM sources due to metal-to-metal contact at the mesh corners (where pairs of edge strips 162 and 164 meet).

The process for designing the flat pattern minimizes tension variation in the mesh caused by forming it into a doubly curved surface. Additionally, the process precludes the need to compress the edge treatment (possibly causing it to wrinkle) or to significantly stretch it.

With regard to mesh attachment, the process offers several advantages:

a) the choice of material and design of the mesh edge treatment to have a low stiffness permits the introduction of some reasonable tension change in it without a significant change in the net catenary tension or shape.

b) the use of relatively wide tabs 170 to attach the mesh to the net outer catenaries 66, allows for some stress-free adjustment between them in order to correct for net/mesh fabrication tolerances.

c) The attachment sequence described (temporary perimeter attachment, followed by mesh center attachment, then final perimeter attachment) minimizes tension variation in the reflecting mesh 48 during its installation.

d) Using light distributed gravity loading on the reflecting mesh 48 during its installation forces the reflecting mesh 48 to assume the desired doubly-curved shape while minimizing in-plane tension variability during the mesh to net sewing process. It also eliminates the need for accurately pre-defining the locations of the net chords 76 on the flat pattern (which is a difficult analysis/software task) and the need for marking these locations on the reflecting mesh 48 while on the mesh table (which is a time-consuming mesh fabrication step).

Other aspects and features of the present invention can be obtained from a study of the drawings, the disclosure, and the appended claims.

I claim:

1. A method of attaching a flexible reflecting mesh surface to a relatively stiff reflector net without significantly altering the shape thereof or the tension distribution therein, the method including:

installing intermittent flexible tabs along an edge treatment located on an outer boundary of the mesh surface;

temporarily marking the location of at least one centrally-located net cell on the mesh;

suspending the reflecting mesh immediately above the reflector net; and first securing the at least one centrally-located net cell to the mesh, then permanently securing the tabs to the net outer catenaries, and finally securing the mesh to the net along net chords.

2. The method of claim 1, further including securing the net chords to edge portions of the reflecting mesh.

3. The method of claim 1, further including loading the mesh until it contacts the net.

4. The method of claim 1, further including aligning the temporary marking of the at least one centrally-located net cell on the mesh to the corresponding cell on the net and, if necessary, adjusting the tabs to the net outer catenaries until the aligning can be achieved with only minimal in-plane forces being applied to the mesh.

5. A method of attaching a flexible reflecting mesh surface to a relatively stiff reflector net without significantly altering the shape thereof or the tension distribution therein, the method including:

installing intermittent flexible tabs along an edge treatment located on an outer boundary of the mesh surface;

temporarily marking the location of at least one centrally-located net cell on the mesh;

suspending the reflecting mesh immediately above the reflector net;

aligning the temporary marking of the at least one centrally-located net cell on the mesh to a corresponding cell on the net;

temporarily attaching the tabs to the net outer catenaries; and adjusting the temporary attachment of the tabs to the net outer catenaries until the aligning can be achieved with minimal in-plane forces being applied to the mesh.

6. The method of claim 5, further including securing temporary handling chords to edge portions of the reflecting mesh.

7. The method of claim 5, further including loading the mesh until it contacts the net.

8. The method of claim 5, further including first securing the at least one centrally-located net cell to the mesh, then permanently securing the tabs to the net outer catenaries, and finally securing the mesh to the net along net chords.

* * * * *